United States Patent [19]

Shimura et al.

[11] Patent Number: 4,971,000

[45] Date of Patent: Nov. 20, 1990

[54] CAMSHAFT DRIVING ARRANGEMENT FOR DOUBLE OVERHEAD CAMSHAFT ENGINE

[75] Inventors: Toshiya Shimura, Yokohama; Yoshio Iwasa, Nagareyama, both of Japan

[73] Assignee: Nissan Motor Co., Ltd., Yokohama, Japan

[21] Appl. No.: 507,470

[22] Filed: Apr. 11, 1990

[30] Foreign Application Priority Data

May 1, 1989 [JP] Japan ..... 1-112567

[51] Int. Cl.[5] ..... F01L 1/02

[52] U.S. Cl. ..... 123/90.31; 123/41.44; 123/195 A; 123/198 C

[58] Field of Search ..... 123/90.27, 90.31, 41.44, 123/195 A, 198 C

[56] References Cited

U.S. PATENT DOCUMENTS

| | | | |
|---|---|---|---|
| 3,613,645 | 10/1971 | Froumajou | 123/195 A |
| 3,730,147 | 5/1973 | Buchwald | 123/41.44 |
| 4,691,668 | 9/1987 | West | 123/41.44 |
| 4,750,455 | 6/1988 | Ebesu | 123/90.27 |
| 4,889,087 | 12/1989 | Bergsten | 123/90.31 |

FOREIGN PATENT DOCUMENTS

| | | | |
|---|---|---|---|
| 0125531 | 11/1984 | European Pat. Off. | 123/41.44 |
| 0208716 | 7/1957 | Fed. Rep. of Germany | 123/195 A |
| 3630466 | 3/1988 | Fed. Rep. of Germany | 123/90.27 |
| 0211705 | 11/1984 | Japan | 123/90.31 |
| 0271910 | 11/1987 | Japan | 123/90.27 |
| 0285228 | 11/1988 | Japan | 123/90.17 |

*Primary Examiner*—Charles J. Myhre
*Assistant Examiner*—Weilun Lo
*Attorney, Agent, or Firm*—Foley & Lardner, Schwartz, Jeffery, Schwaab, Mack, Blumenthal & Evans

[57] ABSTRACT

A DOHC engine comprises a cylinder block, and a chain which drivingly interconnects a crankshaft and two camshafts. A water pump mounting lug is integrally formed with the cylinder block, and located at the upper portion of a front wall of the cylinder block and below one of the two camshafts. The chain has a loose side defined by that portion thereof which runs between the crankshaft and the one of the camshafts. A movable chain guide bows the loose side of the chain inwardly to define a mounting site of a water pump.

1 Claim, 4 Drawing Sheets

CAMSHAFT DRIVING ARRANGEMENT FOR DOUBLE OVERHEAD CAMSHAFT ENGINE

BACKGROUND OF THE INVENTION

The present invention relates to a camshaft driving arrangement for a double overhead camshaft (hereinafter referred as to DOHC) engine.

JP 57-83617 discloses a conventional camshaft driving arrangement for a DOHC engine as shown in FIG. 6.

Referring to FIG. 6, a crankshaft 45 is rotatably mounted to a cylinder block 44, whereas two camshafts 42, 43 are rotatably mounted to a cylinder head 41 disposed on the cylinder block 44. A crank sprocket 46, and two cam sprockets 47, 48 are coupled with the crankshaft 45, and the camshafts 42, 43, respectively. Torque is transmitted from the crankshaft 45 to the two camshafts 42, 43 by means of a rubber timing belt 49.

For recirculating an engine coolant, a water pump (not shown) is disposed on a front wall of the cylinder block 44, and includes a pump shaft 51. Coupled with the pump shaft 51 is a pump sprocket 52 with which the timing belt 49 is in engagement. Thus, torque is transmitted to the water pump from the timing belt 49 through the pump sprocket 52.

The timing belt 49 circulates in a direction as indicated by arrows in FIG. 6, and it is pressed, by a movable tensioner roller 53, on a loose side thereof **49*b* which is positioned between the crank sprocket 46 and the cam sprocket 47**.

A problem encountered in such conventional camshaft driving arrangement is that, since the pump sprocket 52 is in engagement with the timing belt 49 on a tension side **49*a* theareof, the cylinder block 44** should be increased in width for arranging the water pump, resulting in enlarged dimension and increased weight of the engine.

SUMMARY OF THE INVENTION

An object of the present invention is to provide a camshaft driving arrangement for a DOHC engine which contributes much to a reduction in width and weight of the engine.

According to the present invention, there is provided, in a DOHC engine:

a cylinder block;

a cylinder head on said cylinder block;

a crankshaft rotatably mounted to said cylinder block;

a first camshaft rotatably mounted to said cylinder head;

a second camshaft rotatably mounted to said cylinder head;

said crankshaft, said first camshaft, and said second camshaft having one end portions, respectively, which are arranged within a predetermined substantially triangular area on said cylinder block and said cylinder head;

a chain drivingly interconnecting said crankshaft, said first camshaft, and said second camshaft at said one end portions thereof, said chain having a loose side defined by that portion thereof which runs between said first camshaft and said crankshaft;

guide means for bowing said loose side of said chain inwardly of said predetermined triangular area to define a mounting site extending to overlap partially said predetermined triangular area; and a water pump mounted on said mounting site.

DETAILED DESCRIPTION OF THE INVENTION

Referring to the accompanying drawings, a preferred embodiment of a camshaft driving arrangement for a DOHC engine according to the present invention will be described.

Figure 1:
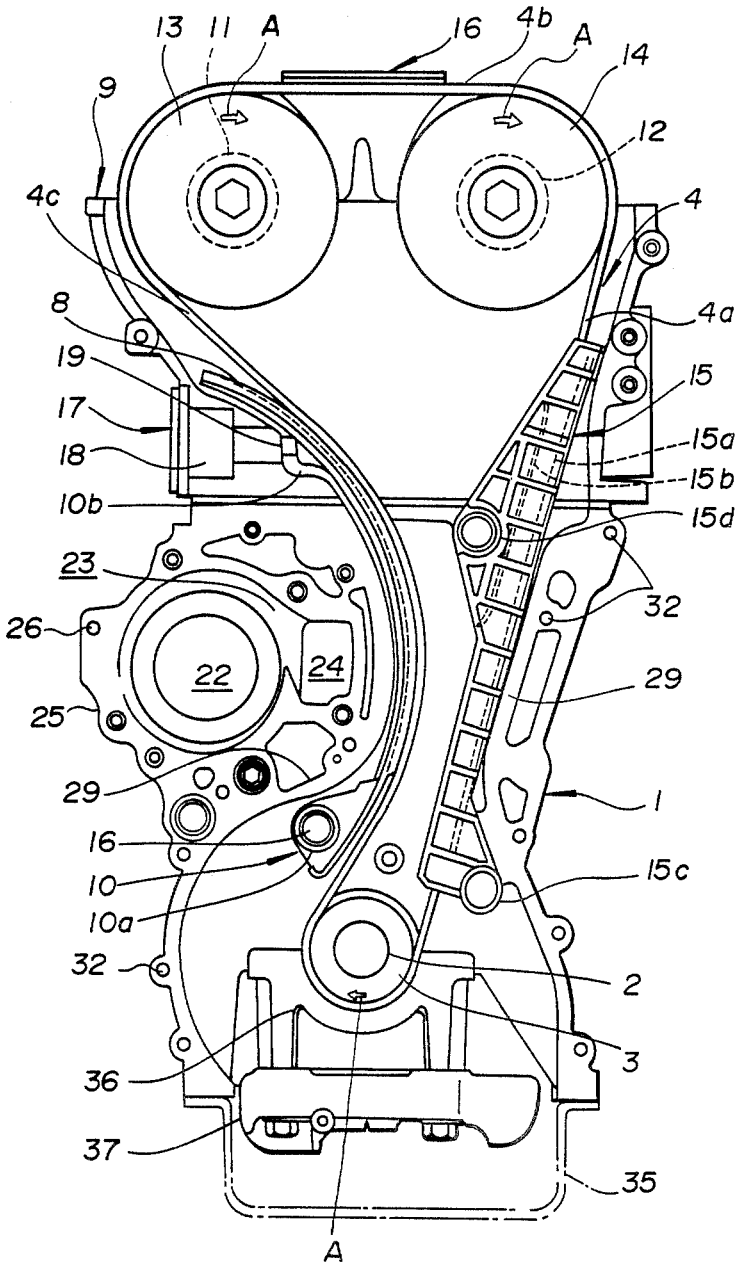
FIG. 1 is a front view illustrating a DOHC engine to which a preferred embodiment of a camshaft driving arrangement according to the present invention is applied, with some components removed.

Referring to FIG. 1, a crankshaft 2 is rotatably mounted to a cylinder block 1. Secured to the cylinder block 1 is a cylinder head 9 to which an intake camshaft 11 for cyclically opening and closing intake valves and an exhaust camshaft 12 for cyclically opening and closing exhaust valves are rotatably mounted. A crank sprocket 3 is coupled with the crankshaft 2, whereas two cam sprockets 13, 14 are coupled with the camshafts 11, 12. A timing chain 4 drivingly interconnects the crank sprocket 3 and the cam sprockets 13, 14, and circulates in a direction indicated by arrows A in FIG. 1. The intake and exhaust camshafts 11, 12 rotate at a speed one half the rotational speed of the crankshaft 2. A reference numeral 36 denotes bearing caps which are arranged between cylinders for rotatably supporting the crankshaft 2, and 37 a beam having the bearing caps 36.

A stationary chain guide 15 is arranged on a tension side **4*a* of the timing chain 4. The tension side 4*a* is defined by that portion of the timing chain 4 which runs between the exhaust cam sprocket 14 and the crank sprocket 3. The stationary chain guide 15 includes two linear guide faces 15*a*, 15*b* which are opposed to each other at predetermined intervals, thus preventing the timing chain 4 from vibrating. Reference numerals 15*c*, 15*d* denote bosses, respectively, with which the chain guide 15 is held stationary relative to the cylinder block 1**.

In order to apply the tension to the timing chain 4, a movable chain guide 10 is arranged on a loose side **4*c* of the timing chain 4. The loose side 4*c* is defined by that portion of the timing chain 4 which runs between the crank sprocket 2 and the intake cam sprocket 13. The movable chain guide 10 is shaped like a bow, and includes a shoe 8 which is in contact with the timing chain 4. The movable chain guide 10 is formed with a boss 10*a* at the lower end thereof as viewed in FIG. 1, and it is swingably mounted to the cylinder block 1 through a shaft 16 which extends through in slidable engagement with the boss 10*a*. Additionally, this chain guide 10 includes a support 10*b* at the upper portion thereof as viewed in FIG. 1. For pressing the timing chain 4 which the chain guide 10, a chain tensioner 17 is arranged at a position adjacent to the support 10***b*.

A casing 18 of the chain tensioner 17 is fixedly mounted to the cylinder head 9. The chain tensioner 17 includes a plunger 19 which protrudes under pressure of a lubrication oil introduced into the casing 18 and comes in contact with the support portion 10*b*.

Figure 2:
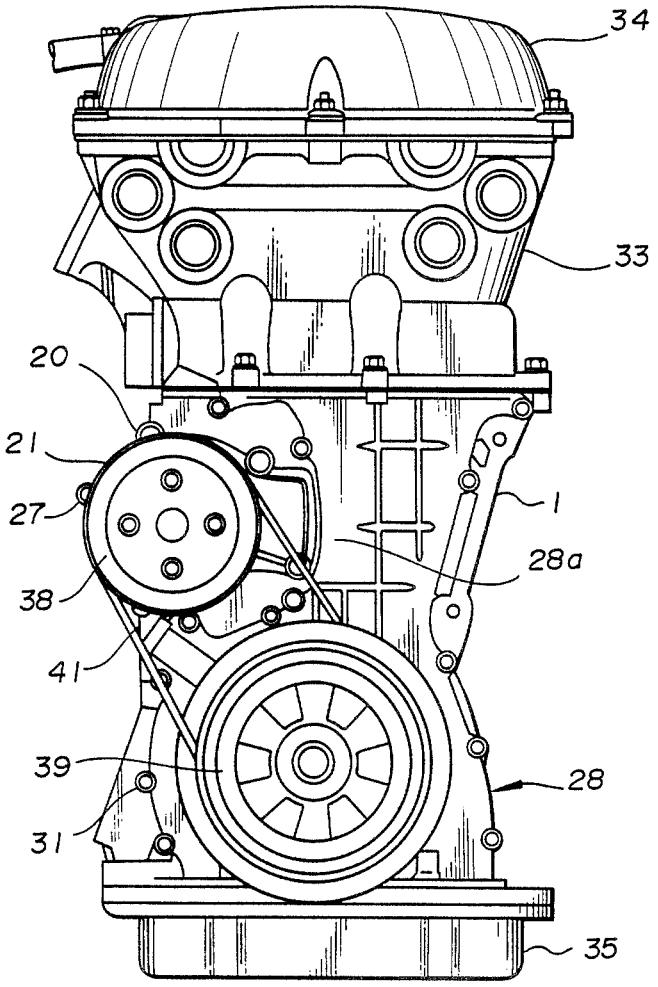
FIG. 2 is a view similar to FIG. 1, but illustrating the DOHC engine normally mounted.

Referring to FIG. 2, a chain cover 28 for concealing the timing chain 4, the guides 10, 15, and the crank sprocket 3 is attached to the cylinder block 1 on a front wall thereof. Arranged at the upper portion of the front wall and at a position adjacent to the chain cover 20 is a water pump 21. A reference numeral 33 denotes a chain chamber defining wall which is arranged at a front end of the cylinder head 9, 34 a cam cover which is mounted on the cylinder head 9, and 35 an oil pan which is mounted to the lower end of a skirt portion of the cylinder block 1.

A pump pulley 38 is coupled with a drive shaft of the water pump 21, whereas a crank pulley 39 is coupled with the crankshaft 2 on the outside of the chain cover 33. An accessory driving belt 41 drivingly interconnects the pump pulley 38 and the crank pulley 39.

The water pump 21 forcedly recirculates a coolant by rotation of vanes (not shown). As best seen in FIG. 1, the water pump 21 sucks via a pump inlet 22 the coolant within a radiator in a pump chamber 23, and discharges the coolant via a pump outlet 24 into coolant passages around the cylinders. The pump inlet and outlet 22, 24 are formed through the cylinder block 1.

Referring again to FIG. 1, a mounting lug 25 for connecting a housing 20 of the water pump 21 is integrated with the front wall of the cylinder block 1. The mounting lug 25 surrounds the pump chamber 23 and the pump outlet 24, and it is formed with a plurality of holes 26, for bolts 27 for securing the pump housing 20.

At a position adjacent to the mounting lug 25, a mounting lug 29 for connecting the chain cover 28 is integrated with the front wall of the cylinder block 1. The mounting lug 29 is formed with a plurality of holes 32 for bolts 31 for securing the chain guide 10.

The pump mounting lug 25 is located at the upper portion of the front wall of the cylinder block 1 and below the intake cam sprocket 13.

The shaft 16, serving as a pivot center of the movable chain guide 10, is disposed below the water pump 21. The chain tensioner 17 is disposed between the water pump 21 and the intake cam sprocket 13. The movable chain guide 10 is curved in a manner to detour the water pump 21, and located substantially on a center line which bisects a front face of the cylinder block 1. The chain cover mounting lug 29 and a left upper portion 28*a* of the chain cover 28 are curved along the chain guide 10 (also refer to FIG. 3).

Figure 3:
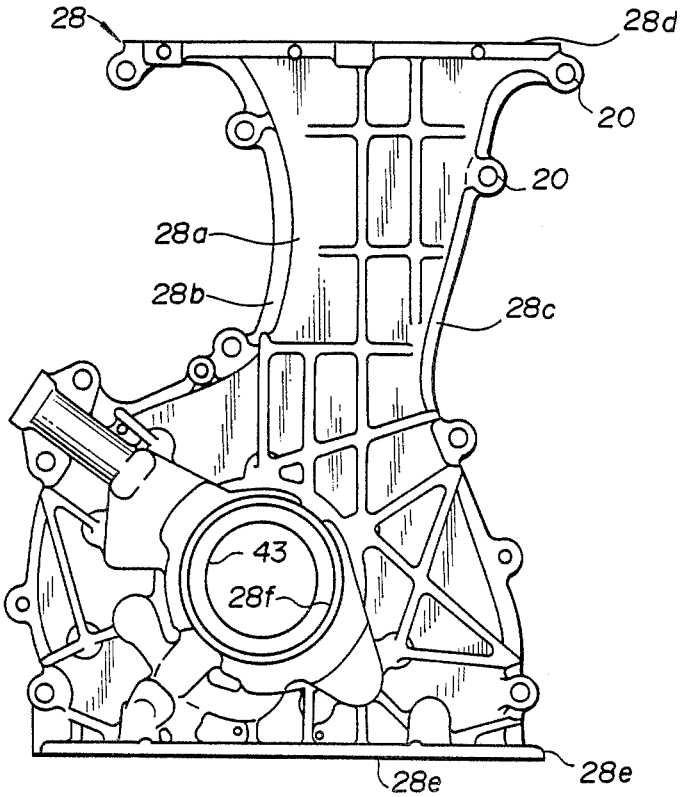
FIG. 3 is a front elevation illustrating a chain cover.
Figure 4:
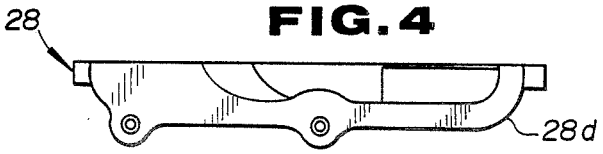
FIG. 4 is a diagrammatic view of the chain cover as viewed from the top thereof.
Figure 5:
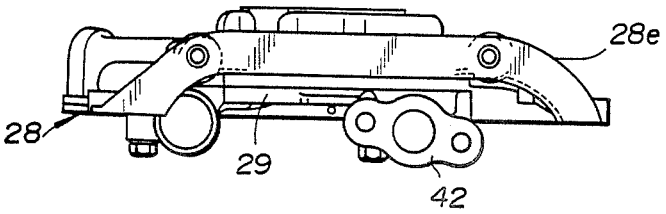
FIG. 5 is a view similar to FIG. 4, but as viewed from the bottom of the chain cover.
Figure 6:
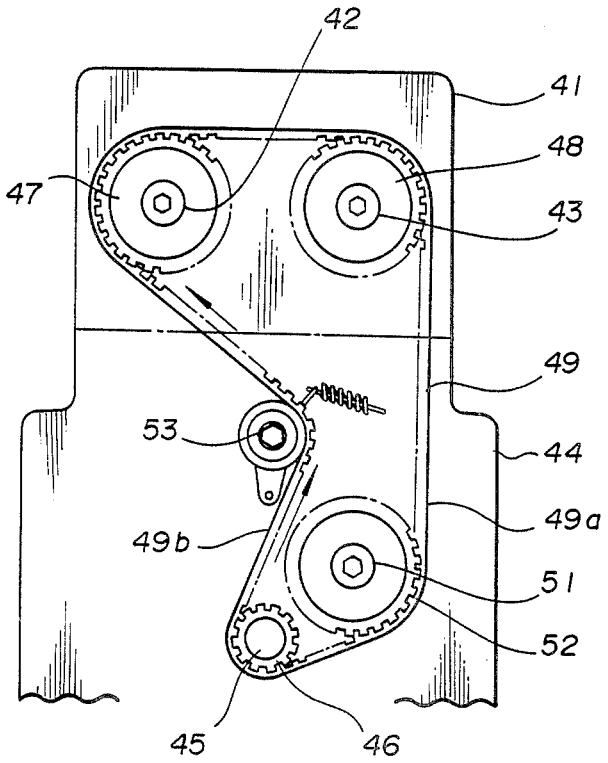
FIG. 6 (PRIOR ART)
FIG. 6 is a schamatic plan view illustrating a conventional camshaft driving arrangement for a DOHC engine.

Referring to FIGS. 3, 4 and 5, the chain cover 28 has two integral flanges 28*b*, 28*c* adapted to be conneted to the chain cover mounting lug 29 of the cylinder block 1, an integral flange 28*d* adapted to be connected to the cam cover 34, and a flange 28*e* adapted to be connected to the oil pan 35. An oil pump 41 is arranged at the outer periphery of an opening 28*f* in which the crankshaft 2 is inserted (also refer to FIG. 2). The chain cover 28 has a flange adapted to be connected to an oil strainer, and a seal member 43 for an oil tight seal with the crankshaft 2.

Next, the operation of this embodiment will be described.

As shown in FIG. 1, the timing chain 4 has the tension side 4*a* which is put linearly, and the loose side 4*c* which is put curvedly through the movable chain guide 10. The timing chain 4 is disposed in a manner that the loose side 4*c* is adjacent to the tension side 4*a*. Since the chain 4 circulates in a right half of the cylinder block 1 with respect to the center line as viewed in FIG. 1, a mounting site of the water pump 21 is provided in a left half of the cylinder block 1 as viewed in FIG. 1. Thus, the water pump 21 does not protrude greatly from the lateral side of the cylinder block 1, resulting in reduction in which of the engine.

Further, since the outlet 24 of the water pump 21 is formed in the center of the cylinder block 1 and toward the center of the cylinders (not shown), a large quantity of coolant can smoothly be distributed on both sides of the cylinders during operationg of the engine, achieving an uniform cooling of the cylinders.

Furthermore, the chain cover 28 is reduced in upper width as is readily understood from FIG. 3, resulting in reduction in weight of engine. Besides, the chain cover 28 possesses increased structural rigidity, contributing much to a reduction in vibration and noise during operation of the engine.

What is claimed is:

1. In a DOCH engine:

a cylinder block;

a cylinder head on said cylinder block;

a crankshaft rotatably mounted to said cylinder block;

a first camshaft rotatably mounted to said cylinder head;

a second camshaft rotatably mounted to said cylinder head;

said crankshaft, said first camshaft, and said second camshaft having one end portions, respectively, which are arranged within a predetermined substantially triangular area on said cylinder block and said cylinder head;

a chain drivingly interconnecting said crankshaft, said first camshaft, and said second camshaft at said one end portions thereof, said chain having a loose side defined by that portion thereof which runs between said first camshaft and said crankshaft;

guide means for bowing said loose side of said chain inwardly of said predetermined triangular area to define a mounting site extending to overlap partially said predetermined triangular area; and a water pump mounted on said mounting site.

* * * * *